US008840421B2

(12) United States Patent
Li et al.

(10) Patent No.: US 8,840,421 B2
(45) Date of Patent: Sep. 23, 2014

(54) ELECTRICAL CONNECTOR ASSEMBLY EQUIPPED WITH ENHANCED LOCKING MECHANISM THEREON

(75) Inventors: Chun-Sheng Li, Kunshan (CN); Bin Peng, Kunshan (CN); Jun Wang, Kunshan (CN)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 153 days.

(21) Appl. No.: 13/492,921

(22) Filed: Jun. 10, 2012

(65) Prior Publication Data

US 2012/0322292 A1 Dec. 20, 2012

(30) Foreign Application Priority Data

Jun. 20, 2011 (CN) ..... 2011 1 0165991

(51) Int. Cl.
*H01R 13/627* (2006.01)

(52) U.S. Cl.
CPC ..... *H01R 13/6275* (2013.01)
USPC ..... 439/357

(58) Field of Classification Search
USPC ..... 439/357, 358, 350, 345
See application file for complete search history.

(56) References Cited

U.S. PATENT DOCUMENTS

| | | | | | |
|---|---|---|---|---|---|
| 2,194,769 | A | * | 3/1940 | Reed | 439/358 |
| 2,569,037 | A | * | 9/1951 | Dalton | 439/368 |
| 2,656,203 | A | * | 10/1953 | Musser | 403/11 |
| 3,005,176 | A | * | 10/1961 | Berg | 439/369 |
| 3,523,269 | A | * | 8/1970 | Bissland et al. | 439/358 |
| 3,671,921 | A | * | 6/1972 | Baker et al. | 439/353 |
| 3,842,393 | A | * | 10/1974 | Glover et al. | 439/281 |
| 4,010,998 | A | * | 3/1977 | Tolnar et al. | 439/358 |
| 4,045,108 | A | * | 8/1977 | Olsen | 439/368 |
| 4,200,350 | A | * | 4/1980 | Zimmerman, Jr. | 439/357 |
| 4,253,721 | A | * | 3/1981 | Kaufman | 439/372 |
| 4,284,313 | A | * | 8/1981 | Anhalt | 439/350 |
| 4,402,564 | A | * | 9/1983 | Frantz | 439/350 |
| 4,544,225 | A | * | 10/1985 | Raus et al. | 439/345 |
| 4,707,045 | A | * | 11/1987 | Ney et al. | 439/588 |
| 4,840,577 | A | * | 6/1989 | Prouty | 439/373 |
| 4,897,039 | A | * | 1/1990 | Uchida et al. | 439/372 |
| 4,898,548 | A | * | 2/1990 | Case et al. | 439/686 |

(Continued)

FOREIGN PATENT DOCUMENTS

| | | | |
|---|---|---|---|
| CN | 1532995 | A | 9/2004 |
| CN | 201054435 | Y | 4/2008 |
| CN | 201020209133.7 | | 3/2011 |
| TW | M324330 | | 12/2007 |

*Primary Examiner* — Amy Cohen Johnson
*Assistant Examiner* — Vladimir Imas
(74) *Attorney, Agent, or Firm* — Wei Te Chung; Ming Chieh Chang

(57) ABSTRACT

An electrical connector assembly includes a receptacle connector and a plug connector. The receptacle connector includes a housing unit defining a mating cavity communicating with an exterior via an insertion opening at a front end thereof. A plurality of contact grooves are defined within the housing unit and extend along a front-to-rear direction. A plurality of contacts are arranged in the contact grooves in a side-by-side manner. A pair of elastic locking devices are disposed at opposite sides of the mating cavity and each has a pair of locking arms projecting into the mating cavity. The locking arms are formed within a common plane which is perpendicular to the front-to-rear direction. The plug connector is inserted into the mating cavity and clipped by the locking arms so as to realize a better retaining effect.

19 Claims, 7 Drawing Sheets

(56) References Cited

U.S. PATENT DOCUMENTS

| | | | | | |
|---|---|---|---|---|---|
| 4,964,809 | A * | 10/1990 | Jobson | 439/357 |
| 5,011,426 | A * | 4/1991 | Colleran et al. | 439/357 |
| 5,044,975 | A * | 9/1991 | DiBene et al. | 439/352 |
| 5,137,466 | A * | 8/1992 | Endo et al. | 439/357 |
| 5,178,556 | A * | 1/1993 | Chen | 439/357 |
| 5,178,557 | A * | 1/1993 | Hashiguchi | 439/357 |
| 5,201,669 | A * | 4/1993 | Lin | 439/357 |
| 5,334,041 | A * | 8/1994 | Anbo et al. | 439/358 |
| 5,340,329 | A * | 8/1994 | Hirai | 439/357 |
| 5,486,117 | A * | 1/1996 | Chang | 439/357 |
| 5,588,864 | A * | 12/1996 | Lin | 439/357 |
| 5,613,870 | A * | 3/1997 | Traver, Jr. | 439/352 |
| 5,727,970 | A * | 3/1998 | Koguchi et al. | 439/607.28 |
| 5,741,150 | A * | 4/1998 | Stinson et al. | 439/358 |
| 5,775,931 | A * | 7/1998 | Jones | 439/358 |
| 5,820,400 | A * | 10/1998 | Yamanashi et al. | 439/358 |
| 5,971,790 | A * | 10/1999 | Rohde | 439/357 |
| 6,168,453 | B1 * | 1/2001 | Kuo | 439/357 |
| 6,217,364 | B1 * | 4/2001 | Miskin et al. | 439/358 |
| D441,718 | S * | 5/2001 | Weng et al. | D13/147 |
| 6,280,227 | B1 * | 8/2001 | Terada et al. | 439/357 |
| 6,290,530 | B1 * | 9/2001 | Chang | 439/378 |
| 6,514,099 | B2 * | 2/2003 | Endo | 439/489 |
| 6,517,372 | B1 * | 2/2003 | Jones | 439/346 |
| 6,607,397 | B1 * | 8/2003 | Zhang et al. | 439/357 |
| 6,612,860 | B2 * | 9/2003 | Droesbeke | 439/357 |
| 6,821,159 | B2 * | 11/2004 | Munger et al. | 439/680 |
| 6,976,876 | B1 * | 12/2005 | Su et al. | 439/607.57 |
| 7,014,493 | B1 * | 3/2006 | Battard | 439/373 |
| 7,297,012 | B1 * | 11/2007 | Hwang et al. | 439/347 |
| 7,404,731 | B2 * | 7/2008 | Lim | 439/489 |
| 7,429,701 | B1 * | 9/2008 | Kushnir et al. | 174/53 |
| 7,510,431 | B2 * | 3/2009 | Zhu et al. | 439/567 |
| 7,524,205 | B1 * | 4/2009 | Lee | 439/372 |
| 7,549,887 | B1 * | 6/2009 | Ng et al. | 439/352 |
| 7,578,693 | B2 * | 8/2009 | Yoshida et al. | 439/352 |
| 7,661,977 | B2 * | 2/2010 | Zayas et al. | 439/357 |
| 7,695,305 | B1 * | 4/2010 | Ray et al. | 439/359 |
| 8,011,946 | B2 * | 9/2011 | Chen et al. | 439/345 |
| 8,075,331 | B2 * | 12/2011 | Gazelot et al. | 439/353 |
| 8,092,246 | B1 * | 1/2012 | Santiago | 439/357 |
| 8,308,500 | B2 * | 11/2012 | Davison et al. | 439/345 |
| 8,328,576 | B2 * | 12/2012 | Chen et al. | 439/350 |

* cited by examiner

ELECTRICAL CONNECTOR ASSEMBLY EQUIPPED WITH ENHANCED LOCKING MECHANISM THEREON

BACKGROUND OF THE INVENTION

1. Field of the Invention

The present invention relates to an electrical connector assembly, and more particular to an electrical connector assembly equipped with enhanced locking mechanism thereon.

2. Description of the Related Art

Chinese Pat. No. 201020209133.7 issued on Mar. 2, 2011 discloses an electrical connector assembly including a plug connector and a receptacle connector. The plug connector has a rectangular body portion and a mating portion perpendicular to the body portion. A plurality of contacts are retained within the body portion with contacting portions disposed in the mating portion. The body portion defines a pair of retaining holes at opposite sides of the mating portion. Correspondingly, the receptacle connector defines a receiving cavity at a front end thereof with a plurality of contacts disposed therein. Further, a pair of retaining posts are formed at opposite sides of the receiving cavity. When the mating portion of the plug connector is inserted into the receiving cavity of the receptacle connector, the retaining posts of the receptacle connector are aligning with the retaining holes of the plug connector. For obtaining a better retaining effect, a fastening element such as a screw is further provided and inserted into the retaining post and retaining hole to interengage the plug connector and the receptacle connector together. However, it is not very convenient for a user to release the screw during the use when there is a need to disengage the plug connector from the receptacle connector. Therefore, an electrical connector assembly which can solve the problem is needed.

SUMMARY OF THE INVENTION

Accordingly, an object of the present invention is to provide an electrical connector assembly with an enhanced while easily operated locking mechanism.

In order to achieve the object set forth, an electrical connector assembly comprises a receptacle connector and a plug connector. The receptacle connector comprises a housing unit defining a mating cavity communicating with an exterior via an insertion opening at a front end thereof, a plurality of contact grooves defined within the housing unit and extending along a front-to-rear direction. A plurality of contacts are arranged in the contact grooves in a side-by-side manner. A pair of elastic locking devices are disposed at opposite sides of the mating cavity and each has a pair of locking arms projecting into the mating cavity. Said locking arms are formed within a common plane which is perpendicular to the front-to-rear direction. The plug connector is inserted into said mating cavity and clipped by said locking arms.

Other objects, advantages and novel features of the invention will become more apparent from the following detailed description of the present embodiment when taken in conjunction with the accompanying drawings.

DETAILED DESCRIPTION OF THE INVENTION

Figure 1:
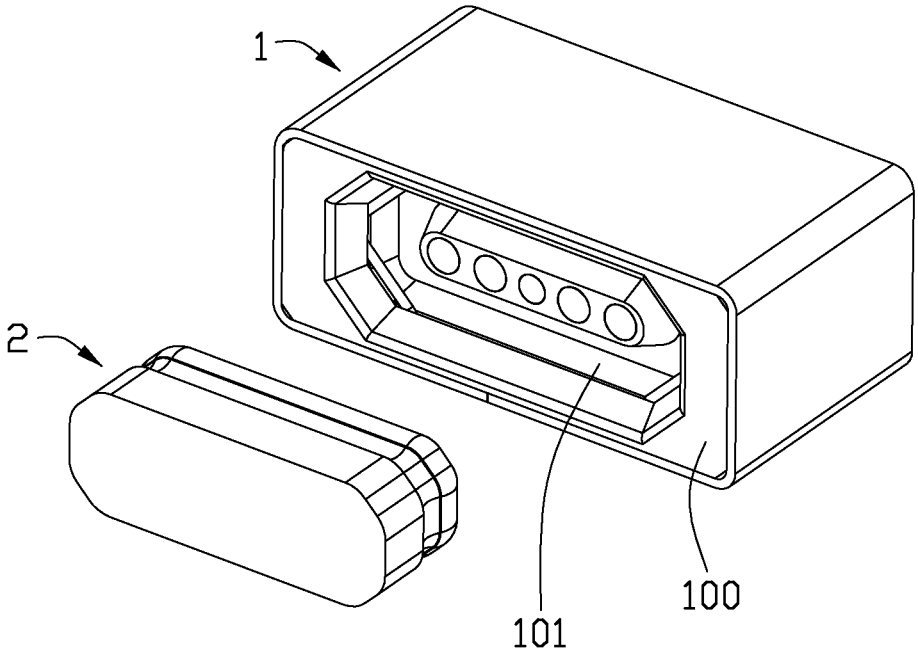
FIG. 1 is a perspective view of an electrical connector assembly in accordance with the present invention, which includes a plug connector and a receptacle connector.

Reference will now be made to the drawing figures to describe a preferred embodiment of the present invention in detail. Referring to FIG. 1, an electrical connector assembly in accordance with the present invention is provided and comprises a receptacle connector 1 and a plug connector 2.

Figure 3:
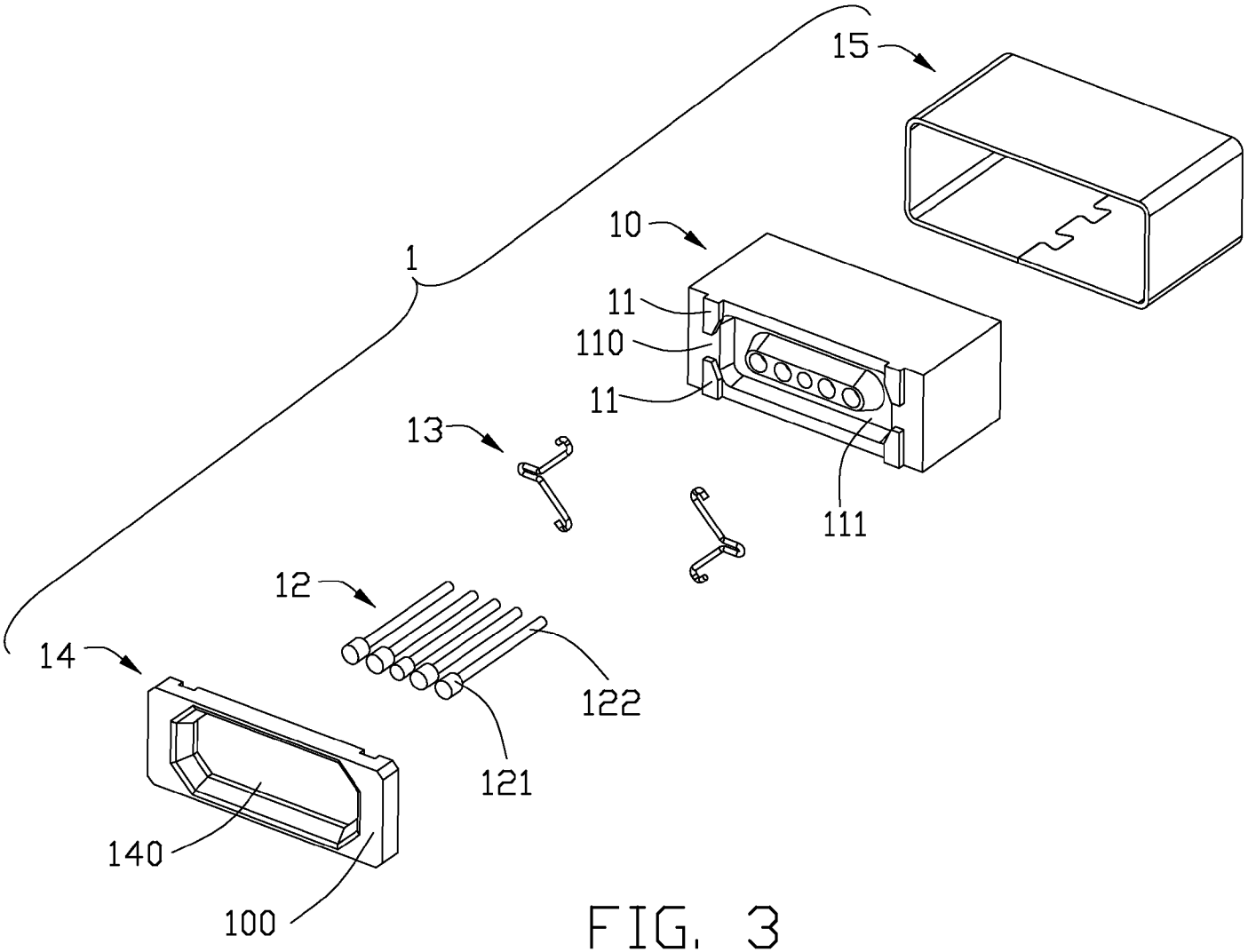
FIG. 3 is an exploded perspective view of the receptacle connector shown in FIG. 1.
Figure 4:
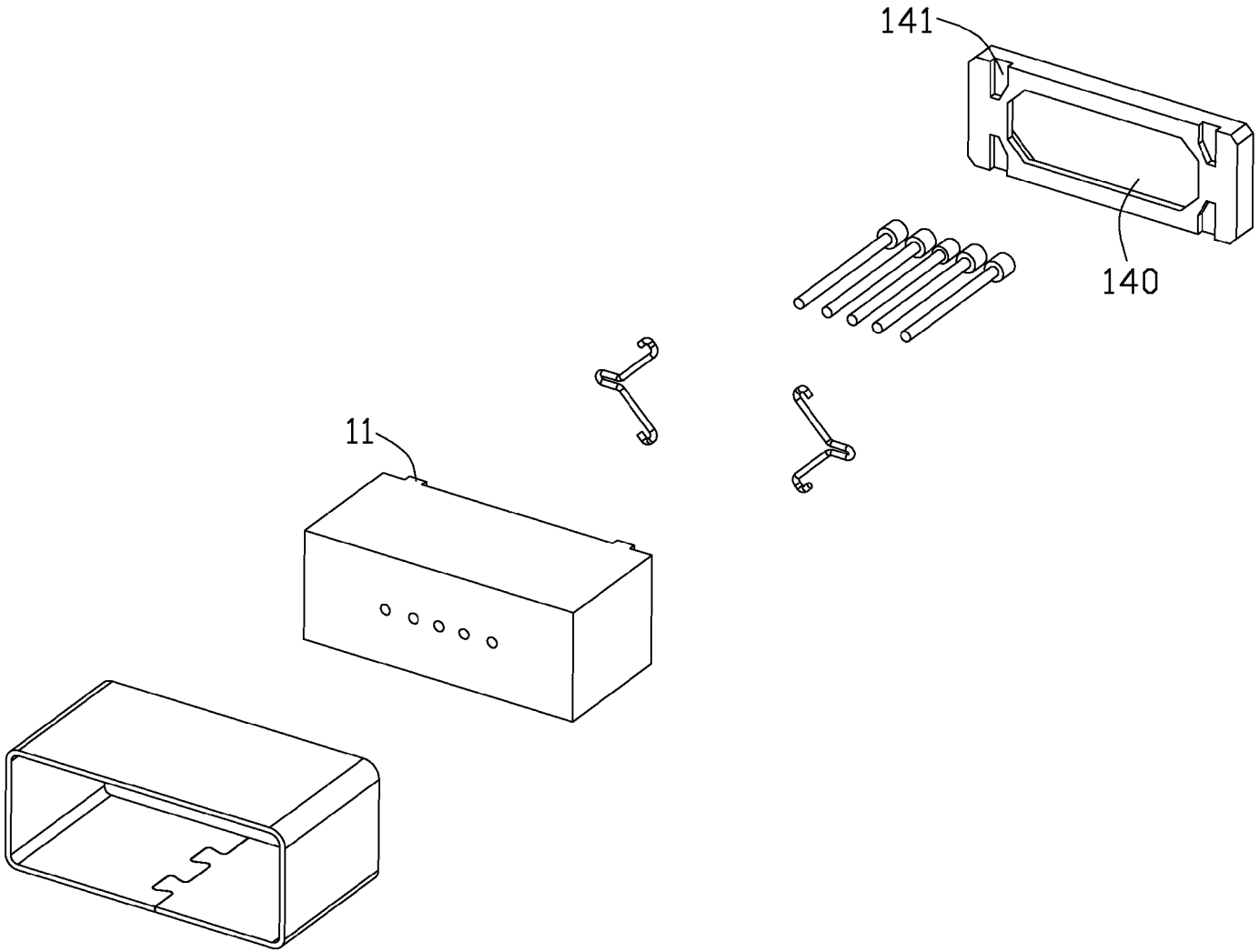
FIG. 4 is another exploded perspective view of the receptacle connector shown in FIG. 3.

Referring to FIGS. 1, 3, and 4, the receptacle connector 1 comprises an insulative housing 10, five contacts 12 retained in the insulative housing 10 in this embodiment, a pair of elastic locking devices 13, a front cover 14, and a shielding member 15 surrounding the insulative housing 10 and front cover 14.

The insulative housing 10 is configured as a rectangular shape and defines a receiving recess 111 at a front section of the insulative housing 10. Four blocks 11 protrude forwardly from four corners of a front section of the insulative housing 10. At each side of the receiving recess 111, an interval 110 is defined between two adjacent blocks 11 and communicates with the receiving recess 111. The front cover 14 is also configured as a rectangular shape and attached to the front section of the insulative housing 10. The front cover 14 defines four receiving slots 141 at four corners for receiving blocks 11 of the insulative housing 10. A front face 100 of the front cover 14 is defined as a mating face for the receptacle connector 1. Further, a mating opening 140 runs through the front face 100 of the front cover 14 and communicates with the receiving recess 111 of the insulative housing 10 so as to commonly define a mating cavity 101. For allowing the plug connector 2 to be inserted into the mating cavity 101 easily, a front section of the mating opening 140 is configured as an inclined structure.

Figure 5:
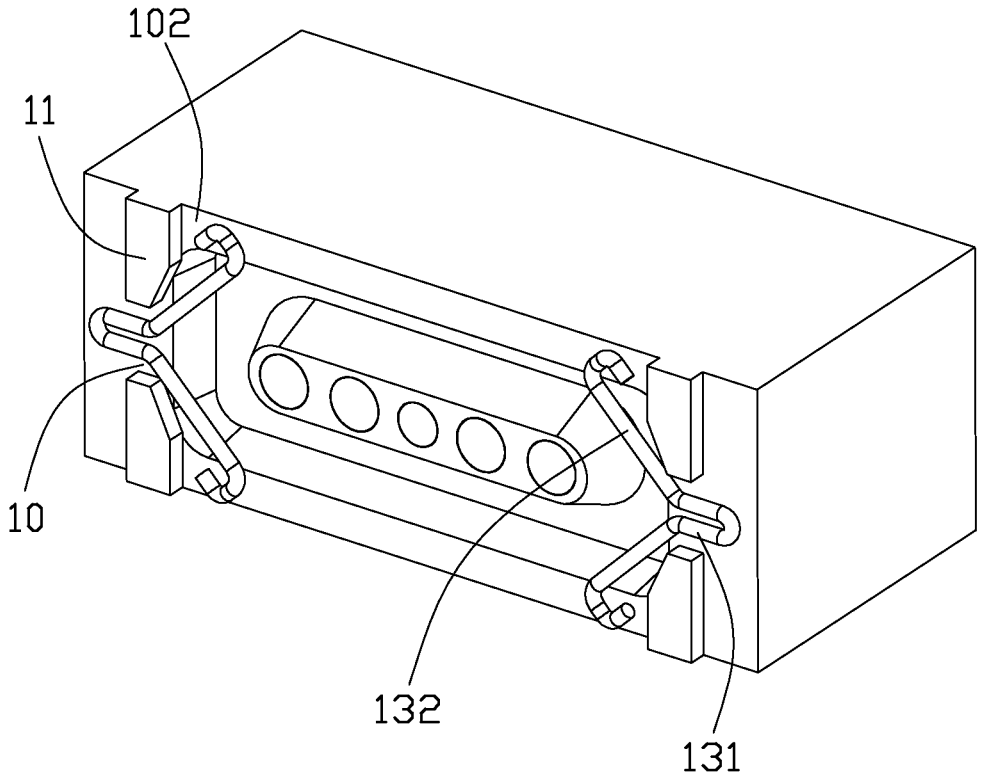
FIG. 5 is a perspective view of the receptacle connector shown in FIG. 1 with a front cover removed.

Referring to FIG. 5, each elastic locking device 13 is made by bending a metallic wire and comprises a retaining portion 131 and a pair of resilient locking arms 132 extending apart from each other from the retaining portion 131. The resilient locking arms 132 together with the retaining portion 131 are formed within a common plane. The locking devices 13 are assembled at opposite ends of the receiving recess 111, with each retaining portion 131 fixed within the interval 110 and the pair of locking arms 132 extending away from the blocks 11 and projecting into the mating cavity 101 and roughly in compliance with a contour of the mating cavity. Further, the front cover 14 is attached to the insulative housing 10 and defines a moving space 102 therebetween for allowing the locking device 13 to move within the plane. As the locking devices 13 are formed within one plane, which will save the space of the moving space 102 and helpful for reducing the size of the receptacle connector 1.

Referring to FIG. 3, each contact 12 is retained in the insulative housing 10 and comprises a contacting portion 121 protruding into the mating cavity 101 and a soldering portion 122 extending rearward. The shielding member 15 is disposed outside the insulative housing 10 and encloses the front cover 14 and the insulative housing 10.

Figure 2:
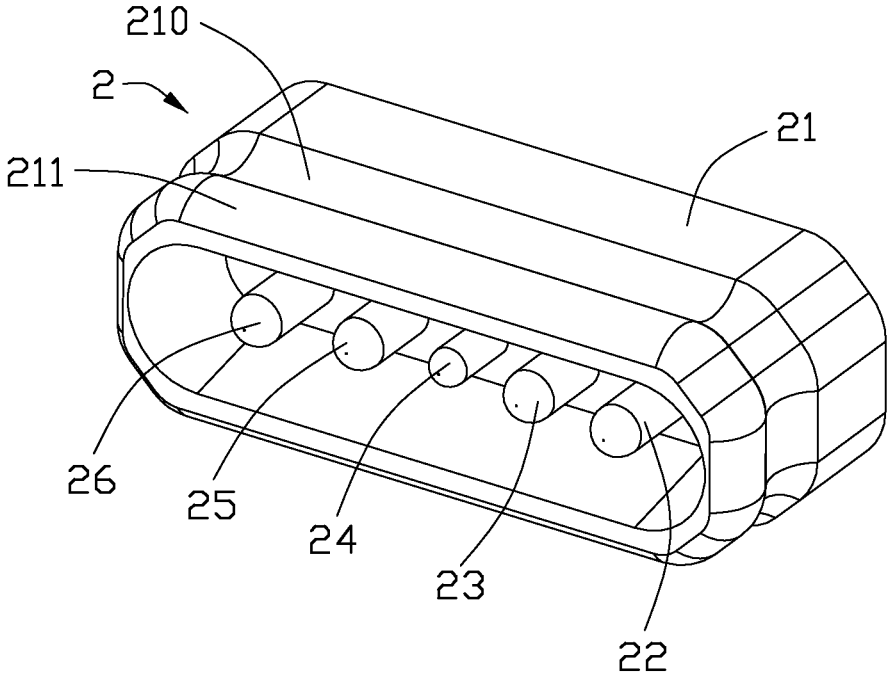
FIG. 2 is a perspective view of the plug connector shown in FIG. 1.

Referring to FIGS. 1 and 2, the plug connector 2 comprises an insulative base 21 and five contacts 22, 23, 24, 25, 26 side by side retained in the insulative base 21. The middle contact 24 acts as a detection contact, the pair of contacts 25, 23 neighboring the middle contact 24 act as power contacts, and the pair of contacts 26, 22 at lateral ends act as grounding contacts. Each contact has a mating portion protruding forwardly, wherein the mating portions of the grounding contacts 26, 22 are longer than those of the power contacts 25, 23, and the mating portions of the power contacts 25, 23 are longer than that of the detection contact 24. Therefore, when the plug connector 2 is mated with the receptacle connector 1, the grounding path is firstly established, then the power supply is established, and at last the detection signal is sent out. The insulative base 21 comprise a concavity portion or groove structure 210 around a periphery of a front section of the insulative base 21 and an insertion portion 211 at a front edge. Both sides of the insertion portion 211 are configured as arc-shape, therefore when the plug connector 2 is mated with the receptacle connector 1, the locking arms 132 biases with the insertion portion 211 and move outwardly relative to each other so as to surpass a peak of the insertion portion 211. That means the four locking arms 132 define a clip space which is smaller than the size of the mating opening 140.

Figure 6:
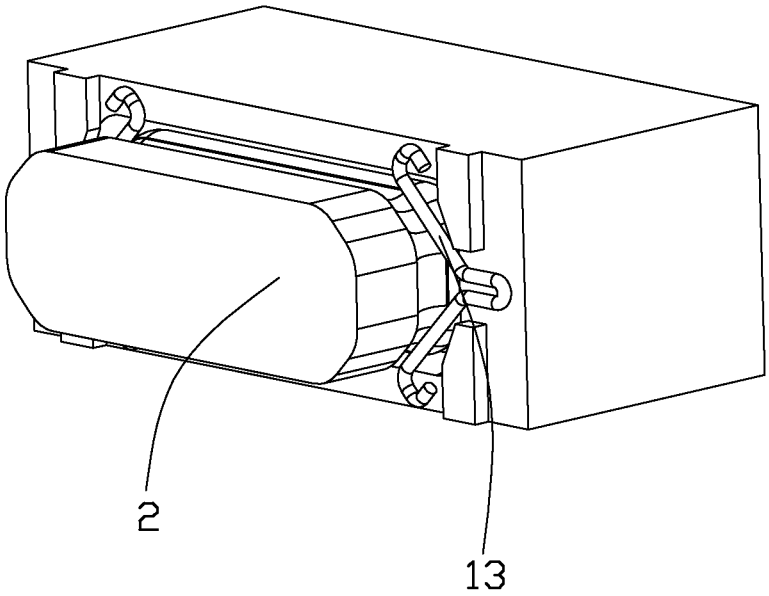
FIG. 6 is a perspective view of the receptacle connector shown in FIG. 5 mated with the plug connector shown in FIG. 2.
Figure 7:
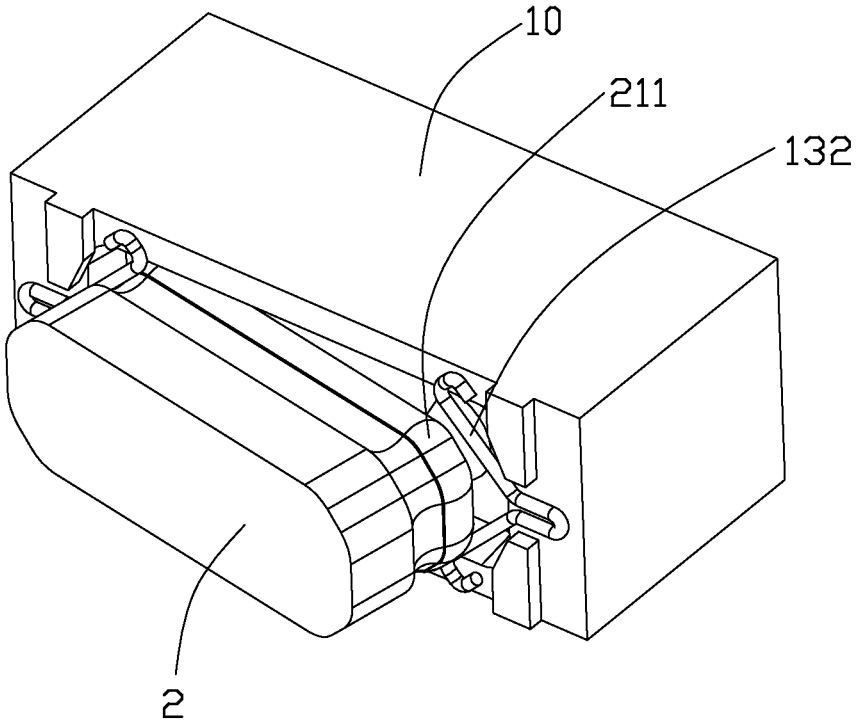
FIG. 7 is a perspective view of the plug connector partly removed from the receptacle connector.

Referring to FIGS. 6 and 7, at a completely mating status, the locking arms 132 are retained within the concavity portion 210 and located under the peak of the insertion portion 211, therefore, the locking arms 132 could not release from the concavity portion 210 easily, and the electrically connection between the receptacle connector 1 and the plug connector 2 can be assured. When the plug connector 2 is released from the receptacle connector 1, there are several ways to choose, for example, the plug connector 2 can be removed by a rotation manner. Firstly, pull one side of the plug connector 2 and then rotate the plug connector with regard to the other side, the locking arms 132 of the receptacle connector 1 could easily release from the concavity portion 210 of the plug connector 2. Beside this, the plug connector 2 could also be directly drawn out of the receptacle connector 1 by an exterior force because each locking arm 132 interacts within the groove structure 210 in a tangential manner. Notably, the groove structure forms a curved cross-sectional for guiding insertion or withdrawal of the locking arm therewith.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector assembly, comprising:

a receptacle connector, comprising a housing unit defining a mating cavity communicating with an exterior via an insertion opening at a front end thereof, a plurality of contact grooves defined within the housing unit and extending along a front-to-rear direction;

a plurality of contacts arranged in the contact grooves in a side-by-side manner;

a pair of elastic locking devices disposed at opposite sides of the mating cavity and each having a pair of locking arms projecting into the mating cavity, said locking arms being formed within a common plane which is perpendicular to the front-to-rear direction; and a plug connector, inserted into said mating cavity and being clipped by said locking arms wherein the housing unit comprises a front cover, a rear insulative housing and a moving space between the front cover and rear insulative housing, the elastic locking devices are received within the moving space, wherein four blocks protrudes forwardly from a front face of the rear insulative housing, the front cover defines four receiving slots for receiving said blocks.

2. The electrical connector assembly as described in claim 1, wherein the locking arms define a clipping space which is smaller than the size of the insertion opening.

3. The electrical connector assembly as described in claim 1, wherein each locking arm is located at a corner of the mating cavity.

4. The electrical connector assembly as described in claim 1, wherein said elastic locking device has a retaining portion inserted into an interval defined between neighboring blocks, said locking arms extend apart from each other from the retaining portion.

5. The electrical connector assembly as described in claim 4, wherein a shielding member is provided to enclose said front cover and rear insulative housing therein.

6. The electrical connector assembly as described in claim 1, wherein the plug connector comprises an insulative base with a plurality of contacts retained therein, the insulative base forms a concavity portion at a front edge thereof for being clipped by said locking arms.

7. The electrical connector assembly as described in claim 6, wherein the concavity portion forms arc-shaped surfaces at its front and rear sides.

8. The electrical connector assembly as described in claim 6, wherein each contact of the plug connector has a contacting portion with different length.

9. A receptacle connector for mating with a plug connector, comprising a housing unit defining a mating cavity communicating with an exterior via an insertion opening at a front end thereof, a plurality of contact grooves defined within the housing unit and extending along a front-to-rear direction;

a plurality of contacts arranged in the contact grooves in a side-by-side manner;

a pair of elastic locking devices disposed at opposite sides of the mating cavity and each having a pair of locking arms projecting into the mating cavity;

wherein said locking arms are formed within a common plane and move outwardly within the common plane when a mating plug is inserted into the mating cavity, said plane is perpendicular to the front-to-rear direction;

wherein each of said locking arms extends into the mating cavity and roughly in compliance with a contour of the mating cavity for locking the plug connector in a tangential manner.

10. The receptacle connector as descried in claim 9, wherein the housing unit comprises a front cover, a rear insulative housing and a moving space between the front cover and rear insulative housing, the elastic locking devices are received within the moving space.

11. The receptacle connector as descried in claim 10, wherein said insertion opening is defined on the front cover, while the rear insulative housing also defines a receiving recess corresponding with the insertion opening.

12. The receptacle connector as described in claim 11, wherein said elastic locking devices are retained at a front face of the rear insulative housing with said locking arms extending apart from each other and projecting into the receiving recess.

13. The receptacle connector as described in claim 10, wherein a shield member is provided to enclose the front cover and the rear insulative housing.

14. An electrical connector assembly comprising:

a receptacle connector including:

an insulative receptacle housing defining an elongated mating port with a pair of long sides and a pair of short sides thereof;

a plurality of receptacle contacts side by side arranged in the receptacle housing along a lengthwise direction parallel to the long side;

a pair of resilient locking devices located at two opposite ends of the long sides and on the corresponding short sides, respectively, and in front of the mating port; and a plug connector including:

an insulative plug housing defining an elongated mating portion with a pair of long sides and a pair of short sides thereof;

a plurality of plug contacts side by side arranged in the plug housing along an elongated direction parallel to the long side of the mating portion for mating with the corresponding receptacle contacts, respectively;

a pair of groove structures formed on two opposite ends of the long sides and one the pair of short sides of the mating portion, respectively, wherein the pair of resilient locking devices are respectively received in the corresponding pair of groove structures, respectively, when the plug connector is mated with the receptacle connector; the pair of resilient locking devices are expanded outwardly and radially to leave the corresponding groove structures, respectively, when the plug connector is unmated with the receptacle connector; wherein the resilient locking device interacts with the corresponding groove structure in a tangential manner so as to be outwardly expanded to leave the corresponding groove structure when the plug connector is unmated from the receptacle connector.

15. The electrical connector assembly as claimed in claim 14, wherein the pair of resilient locking devices are deformable in a plane perpendicular to a mating direction between the plug connector and the receptacle connector.

16. The electrical connector assembly as claimed in claim 14, wherein the pair of groove structures are linked with each other along said long sides.

17. The electrical connector assembly as claimed in claim 14, wherein the resilient locking device performs a cantilevered type deformation during mating within the corresponding mating groove.

18. The electrical connector assembly as claimed in claim 14, further including a front cover to cooperate with the receptacle housing to hold the pair of resilient locking devices therebetween.

19. The electrical connector assembly as claimed in claim 14, wherein the groove structure defines a curved cross-section to guide insertion and withdrawal of the locking device therewith.

* * * * *